United States Patent [19]

Koike

[11] 3,974,729

[45] Aug. 17, 1976

[54] AUTOMATIC RHYTHM PLAYING APPARATUS

[75] Inventor: Masahiko Koike, Hamamatsu, Japan

[73] Assignee: Nippon Gakki Seizo Kabushiki Kaisha, Hamamatsu, Japan

[22] Filed: Feb. 25, 1975

[21] Appl. No.: 552,732

[30] Foreign Application Priority Data

| | | |
|---|---|---|
| Mar. 2, 1974 | Japan | 49-24679 |
| Mar. 2, 1974 | Japan | 49-24678 |
| May 31, 1974 | Japan | 49-63008[U] |

[52] U.S. Cl. ..... 84/1.03; 84/1.01

[51] Int. Cl.[2] ..... G10F 1/00

[58] Field of Search ..... 84/1.01, 1.03, 1.24, 84/DIG. 12

[56] References Cited

UNITED STATES PATENTS

| | | | |
|---|---|---|---|
| 3,549,774 | 12/1970 | Bunger | 84/1.03 |
| 3,549,776 | 12/1970 | Shiga et al. | 84/1.03 |
| 3,629,482 | 12/1971 | Pulfer et al. | 84/1.03 |
| 3,787,601 | 1/1974 | Campbell | 84/1.03 |
| 3,811,003 | 5/1974 | Harris | 84/1.03 |

*Primary Examiner*—Ulysses Weldon

*Attorney, Agent, or Firm*—Spensley, Horn & Lubitz

[57] ABSTRACT

The automatic rhythm producing apparatus according to the invention is capable of providing a clock pulse used for obtaining a basic tempo of a rhythm sound with an irregular pulse period as desired. The apparatus comprises an oscillator for producing a saw-tooth wave signal, a plurality of comparators for comparing this saw-tooth wave signal and a set reference voltage, pulse generation circuits for producing pulses in response to the outputs of the comparators, voltage dividers for supplying the set reference voltages to the comparators, a variable voltage power supply for supplying a variable voltage to the voltage dividers and a pulse generation circuit for producing a pulse when the level of the saw-tooth wave signal drops to zero. The pulse period of a clock pulse obtained by combining the outputs of these pulse generation circuits can be made irregular by suitably varying the variable constant voltage.

8 Claims, 3 Drawing Figures

OSCILL ATOR
1
S
+V
CM1
CM2
CM3
V1
V2
V3
2a
2b
2c
4a
4b
4c
4d
P1
P2
P3
P4
VR
VAR. SUP.
3
5a
5b
5c
5d
FREQ. DIV.
TT
CP
RHYTHM PATTERN FORMING CIRCUIT
6
7
RHYTHM SELECTION CIRCUIT
8
9
PERCUSSION INSTRUMENT SOUND GENERATION CIRCUIT

AUTOMATIC RHYTHM PLAYING APPARATUS

BACKGROUND OF THE INVENTION

1. Field of the Invention

This invention relates to an automatic rhythm producing apparatus and, more particularly, to an automatic rhythm producing apparatus adapted for use with electronic musical instruments.

2. Prior Art

There is a type of automatic rhythm producing apparatus in which basic clock pulses are produced to obtain a desired tempo in various rhythms. According to this type of prior art rhythm producing apparatus, the clock pulses are divided in frequency to produce pulses having pulse periods corresponding to the periods of time of various rhythm sounds. These pulses are suitably selected and combined together to generate rhythm sound signals corresponding to the various rhythms.

In this known apparatus, the period of basic clock pulse is constant and, accordingly, the basic tempo of a rhythm sound is also constant. It has been found that this type of apparatus has difficulty in producing feeling of reality derived from subtle variation in tempo inherent in the performance of a natural percussion instrument. Particularly, it is impossible in this type of apparatus to produce a feeling of "swinging" which is peculiar to jazz performance.

BRIEF SUMMARY OF THE INVENTION

It is, therefore, an object of this invention to provide an automatic rhythm producing apparatus capable of providing a rhythm sound to be sounded with a subtle variation in its basic tempo and thereby producing a rhythm sound which is a very close simulation of a natural percussion instrument sound, particularly provided with the "swinging" effect.

According to the inventive automatic rhythm playing apparatus, a clock pulse oscillator which directly oscillates clock pulses is not used but oscillator which produces a saw-tooth wave signal is employed. Comparators with mutually different reference voltages produce outputs each time the level of the saw-tooth wave signal has reached the respective reference voltages. The outputs of the comparators are differentiated to obtain pulse signals. The interval between the pulse signals can be changed by varying the reference voltages of the comparators by means of a variable power source. On the other hand, the saw-tooth wave signal is differentiated to obtain a pulse signal corresponding to the pulse period of the saw-tooth wave signal. This pulse signal is combined with the pulse signals produced by the comparators to produce a clock pulse used for tempo. A tempo clock pulse with an irregular pulse period is produced by varying the reference voltages of the respective comparators and variation is afforded to the basic tempo of a rhythm sound.

BRIEF DESCRIPTION OF THE DRAWINGS

The invention will now be described in detail with reference to the accompanying drawings in which.

DETAILED DESCRIPTION OF THE INVENTION

Figure 1:
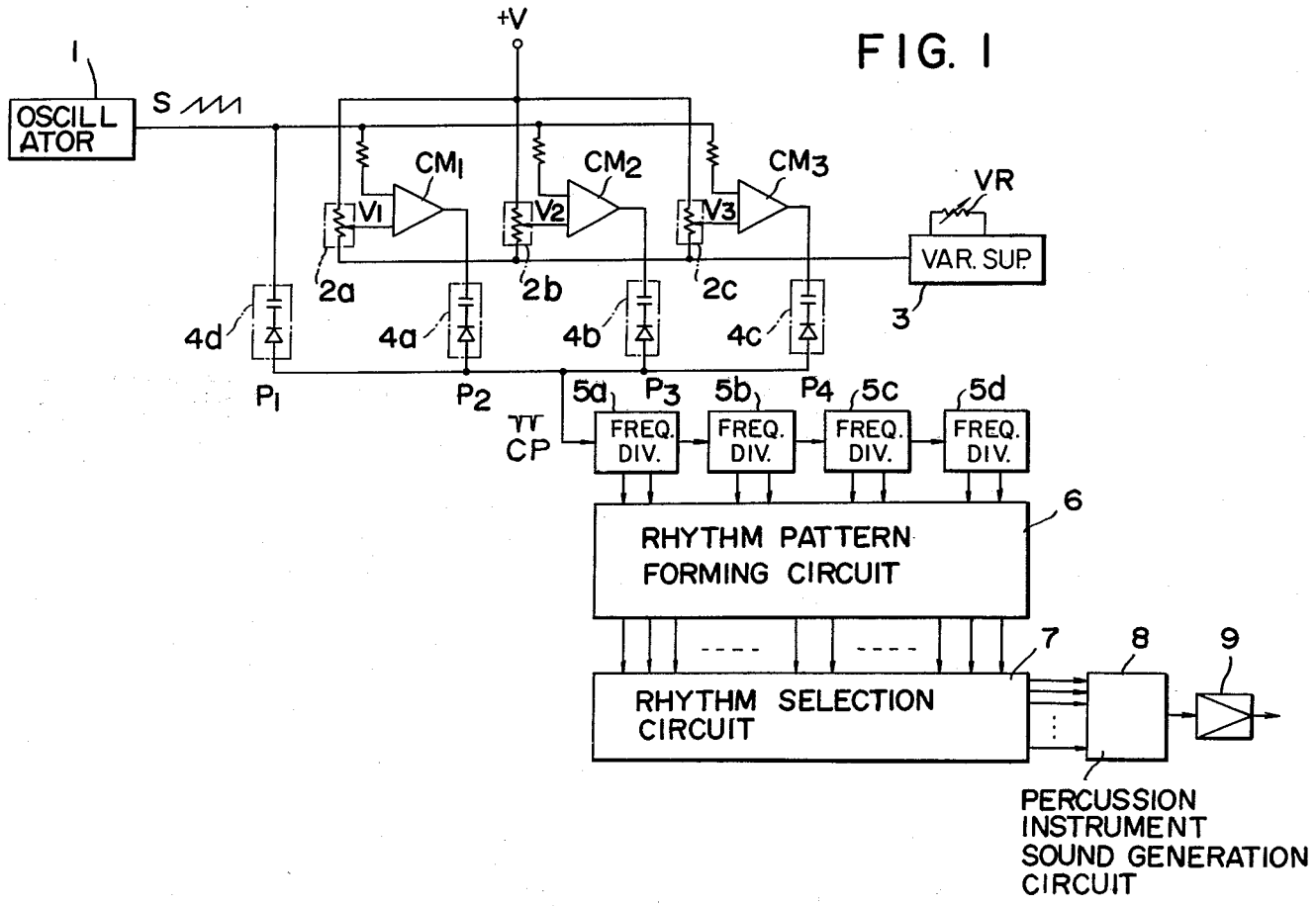
FIG. 1 is a block diagram showing one preferred embodiment of the automatic rhythm producing apparatus according to the invention.

Referring first to FIG. 1, an oscillator 1 produces a saw-tooth wave signal S with a constant pulse period. This saw-tooth wave signal S is applied to inputs of comparators $CM_1$, $CM_2$, and $CM_3$. Set reference voltages of the comparators $CM_1$, $CM_2$ and $CH_3$ are produced in voltage dividing circuits 2*a* – 2*c* and applied to the respective comparators. The voltage dividing circuits 2*a* – 2*c* are adapted to divide the voltage supplied from a variable voltage power supply 3 to produce voltages $V_1$, $V_2$, and $V_3$. The voltage dividing ratios of these voltage dividing circuits are determined in such a manner that $$V_1 = \frac{V_k}{4},\ V_2 = \frac{2}{4}V_k \text{ and } V_3 = \frac{3}{4}V_k$$

(where $V_k$ represents a maximum voltage level of the saw-tooth wave signal S) are applied to the comparators $CM_1$, $CM_2$ and $CM_3$ when a clock pulse of a regular interval is to be produced (hereinafter also referred to as "the reference state").

In this embodiment, a positive power source +V is also used. The power voltage supplied to the voltage dividing circuits 2*a* – 2*c* is determined by a potential difference between this positive power source +V and the variable voltage power supply 3. The voltage from the positive power source +V is constant and the power voltage is changed by varying the variable voltage power supply 3 on the negative side. To eliminate irregularity in the pulse period of a basic tempo clock pulse CP to be used in the reference stage, the maximum voltage level $V_k$ of the saw-tooth wave signal S is set at the same value as the level of the positive power source +V. Accordingly, it will be understood that there exists a condition $V_3 - V_2 = V_2 - V_1 = V_k - V_3$. It will also be appreciated that variation in the voltage supplied by the variable voltage power supply 3 causes variation in the set reference voltages $V_1$, $V_2$ and $V_3$ applied to the comparators.

In the variable voltage power supply 3, the power voltage is changed by changing resistance of a variable resistor VR. An operation lever to which the slider of the variable resistor VR is interlocked is preferably disposed in a place which is readily accessible to the player of the apparatus (e.g. on an operation panel).

The comparators $CM_1$, $CM_2$ and $CM_3$ produce outputs when the voltage level of the saw-tooth wave signal S has exceeded their respective set reference voltages. The outputs of the comparators $CM_1$, $CM_2$ and $CM_3$ are respectively applied to corresponding differentiation circuits 4*a*, 4*b* and 4*c*. The differentiation circuits 4*a*, 4*b* and 4*c* respectively produce pulse signals $P_2$, $P_3$ and $P_4$ upon receipt of the outputs of the respective comparators. Accordingly, as the voltage level of the saw-tooth wave signal S exceeds the respective set reference voltages of the comparators $CM_1$ – $CM_3$, the pulse signals $P_2$ – $P_4$ are successively produced from the differentiation circuits 4*a* – 4*c*. Alternatively stated, the pulse signals $P_2$ – $P_4$ are successively produced in accordance with the change in the voltage level of the saw-tooth wave S. In practice the pulses P1 through P4 and CP shown in FIGS. 2 and 3 may assume a form of a negative going spike with a rapid decay dependent upon the values of the capacitors contained in differentiation circuits 4*a* through 4*d*.

Figure 2:
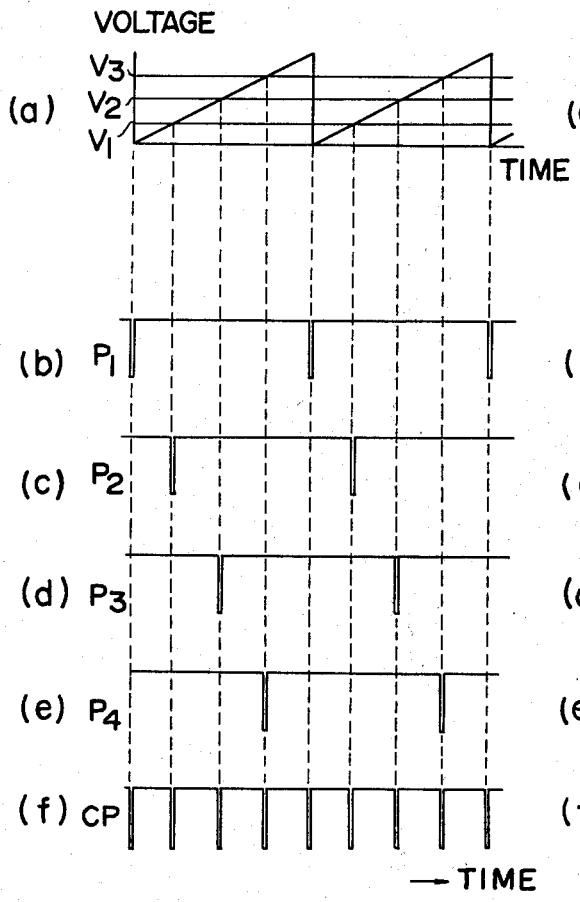
FIG. 2 is a timing chart illustrative of relationship between the respective component parts shown in FIG. 1 in a normal state.

In the meanwhile, the saw-tooth wave signal S of the oscillator 1 is also applied to a differentiation circuit 4*d*. The differentiation circuit 4*d* comprises, in the same manner as the differentiation circuits 4*a* – 4*c*, a capacitor and diode and, each time the voltage level of the saw-tooth wave S drops to zero (i.e. responsive to the minimum output level), produces a pulse signal $P_1$ as illustrated in FIG. 2 (*b*) and FIG. 3(*b*). Accordingly, the pulse period of the pulse signal $P_1$ is constant and equal to the period of the saw-tooth wave signal S.

The output terminals of the differentiation circuits 4*a* – 4*d* are in common connection, so that the pulse signals $P_1$ – $P_4$ are synthesized to form the basic tempo clock pulse CP.

The clock pulse CP is applied to a frequency dividing circuit 5*a* which is known per se, and successively divided in frequency in the dividing circuit 5*a* and subsequent frequency dividing circuits 5*b*, 5*c* and 5*d*. The frequency divided outputs of these frequency dividing circuits 5*a* – 5*d* are respectively applied to a rhythm pattern forming circuit 6 where scores of rhythm pattern signals are produced in a known manner. These rhythm pattern signals are supplied to a rhythm selection circuit 7. A plurality of desired rhythm pattern signals are selected by operation of a rhythm selection switch (not shown) provided in a suitable place such as the operation panel and applied to a percussion instrument sound generation circuit 8. A desired rhythm sound signal is thus produced in the circuit 8 and sounded after amplification through an amplifier 9. The construction and operation of these circuits 5, 6, 7 and 8 are known and detailed description thereof is omitted.

Operation of the inventive automatic rhythm producing apparatus will now be described.

First to be described is a state in which the variable voltage power supply 3 is set at the reference state. As will be apparent from the foregoing description, values of the set reference voltages $V_1$, $V_2$, $V_3$ of the comparators $CM_1$, $CM_2$, $CM_3$ in the reference state are respectively equal to the values at respective dividing points at which the maximum voltage $V_k$ of the saw-tooth wave signal S is equally divided. This relationship between the set reference voltages $V_1$ – $V_3$ and the saw-tooth wave signal S is shown in FIG. 2(*a*). Accordingly, the pulse signals $P_2$ – $P_4$ are output from the differentiation circuits 4*a* – 4*c* in a manner shown in FIG. 2 (*c*), (*d*) and (*e*). These pulse signals $P_2$ – $P_4$ are combined with the pulse signal $P_1$ which is the output of the differentiation circuit 4*d*, thereby forming the basic tempo clock pulse CP as shown in FIG. 2(*f*). The pulse interval of this clock pulse CP in the reference state is constant and, accordingly, the basic tempo of a rhythm sound sounded during this reference state is constant.

If one desires to obtain a clock pulse with an irregular pulse period, such clock pulse is obtained by changing the power voltage supplied from the variable voltge power supply 3 and thereby changing the period between the pulse signals $P_2$, $P_3$ and $P_4$.

Figure 3:
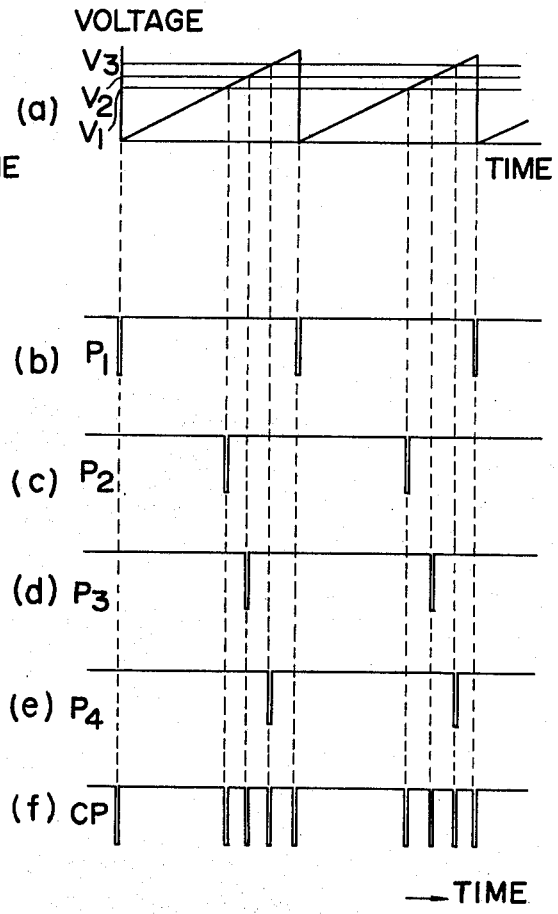
FIG. 3 is a timing chart illustrative of relationship between the respective component parts shown in FIG. 1 when a clock pulse with an irregular pulse period is produced.

If the power voltage from the power supply 3 is increased by operation of the variable resistor VR, the set reference voltages, $V_1$, $V_2$ and $V_3$ increase and the voltage difference between themselves decrease as shown in FIG. 3(*a*). Accordingly, the pulse signals $P_2$ – $P_4$ are produced in a manner as shown in FIG. 3 (*c*), (*d*) and (*e*). The clock pulse CP which is a combination of the pulse signals $P_2$ – $P_4$ and the pulse signal $P_1$ is produced at an irregular interval as shown in FIG. 3(*f*). As will be apparent from the figure, the interval between the pulse signals $P_1$ and $P_2$ is constant and the interval between the pulse signals $P_2$, $P_3$ and $P_4$ is also constant. The clock pulse CP as a whole, however, is produced at an irregular period. This affords a subtle variation to the basic tempo of the rhythm sound to be sounded and thereby enables the audience to feel the "swinging" sensation peculiar to jazz. The irregular period of the clock pulse CP can be changed as desired by suitably changing the power voltage of the variable voltage power supply 3. Thus, the degree of "swinging" in the rhythm sound can be controlled as desired.

In the foregoing example, the saw-tooth wave signal S is divided by three comparators. This arrangement has been described by way of example only and it will be apparent that the saw-tooth wave signal may be divided into any desired number of stages by employment of a plurality of comparators. Further, the differentiation circuits 4*a* – 4*d* may be replaced by other type of circuit which, regardless of its circuit construction, can produce one pulse output in response to a predetermined input. It will also be noted that the tempo of the rhythm sound as a whole can be adjusted by varying oscillation frequency of the saw-tooth wave signal S in the clock oscillator 1.

What is claimed is:

1. An automatic rhythm producing apparatus comprising:

means for generating clock pulses with an irregular pulse period comprising:

means for generating periodic saw-tooth waves;

a plurality of first means for generating an output pulse whenever the magnitude of said saw-tooth waves exceeds a reference level for each of said generating means;

a source of variable voltage;

a plurality of means for setting said reference levels for each of said first generating means, said setting means being coupled to said source of variable voltage and each of said reference levels varying in response to variations in said source of variable voltage;

a second means for generating an output pulse whenever the magnitude of said saw-tooth waves drops to a zero value; and a means for combining the pulses from said plurality of first means and said second means whereby clock pulses with an irregular period are generated;

a plurality of frequency dividing means for dividing in frequency said clock pulses;

means for generating a plurality of rhythm pattern signals upon receipt of said frequency divided variable clock pulses;

a rhythm selection circuit for selecting and outputting a particular rhythm pattern signal or signals from among said rhythm pattern signals; and a percussion instrument sound generation circuit for producing in resonse to said output signals from said rhythm selection circuit, a desired rhythm sound signal.

2. An automatic rhythm producing apparatus as defined in claim 1 wherein said first means for generating an output pulse comprise:

a plurality of voltage comparator circuits; and a plurality of differentiation circuits, each of said differentiation circuits being coupled individually to an output of a comparator circuit.

3. An automatic rhythm producing apparatus as defined in claim 2 wherein said means for setting said reference levels comprise variable resistors with their sliders being connected to the inputs of said comparators, one end of said variable resistors being connected to a power source equivalent to the maximum magnitude of said saw-tooth wave and the other end being connected to said source of variable voltage.

4. An automatic rhythm producing apparatus as defined in claim 2 wherein said source of variable voltage comprises a variable resistor for varying the output voltage and an operation lever connected to the slider of said variable resistor.

5. In an automatic rhythm producing apparatus, an apparatus for generating clock pulses with an irregular pulse period comprising:

means for generating periodic saw-tooth waves;

a plurality of first means for generating an output pulse whenever the magnitude of said saw-tooth waves exceeds a reference level for each of said generating means;

a source of variable voltage;

a plurality of means for setting said reference levels for each of said first generating means, said setting means being coupled to said source of variable voltage and each of said reference levels varying in response to variations in said source of variable voltage; and a means for combining the pulses from said plurality of first pulse generating means whereby clock pulses with an irregular period are generated.

6. An apparatus for generating clock pulses with an irregular pulse period according to claim 5 wherein said first means for generating an output pulse comprise:

a plurality of voltage comparator circuits; and a plurality of differentiation circuits, each of said differentiation circuits being coupled individually to an output of a comparator circuit.

7. An apparatus for generating clock pulses with an irregular pulse period according to claim 6 wherein said means for setting said reference levels comprise variable resistors with their sliders being connected to the inputs of said comparators, one end of said variable resistors being connected to a power source equivalent to the maximum magnitude of said saw-tooth wave and the other end being connected to said source of variable voltage.

8. An apparatus for generating clock pulses with an irregular pulse period according to claim 6 wherein said source of variable voltage comprises:

a constant source of voltage;

a variable resistor coupled to said constant source of voltage for varying the output voltage; and an operation lever connected to the slider of said variable resistor.

* * * * *